US006014963A

United States Patent [19]

Narita

[11] Patent Number: 6,014,963

[45] Date of Patent: Jan. 18, 2000

[54] METHOD AND APPARATUS FOR CONTROLLING THE AIR-FUEL RATIO IN AN INTERNAL COMBUSTION ENGINE

[75] Inventor: Masaki Narita, Shizuoka-ken, Japan

[73] Assignee: Suzuki Motor Corporation, Hamamatsu, Japan

[21] Appl. No.: 09/203,847

[22] Filed: Dec. 2, 1998

[30] Foreign Application Priority Data

Dec. 4, 1997 [JP] Japan ..... 9-350061

[51] Int. Cl.[7] ..... F02D 41/00

[52] U.S. Cl. ..... 123/674; 701/109

[58] Field of Search ..... 123/674; 701/103, 701/104, 109; 60/276

[56] References Cited

U.S. PATENT DOCUMENTS

| | | | |
|---|---|---|---|
| 4,773,016 | 9/1988 | Abe et al. | 701/109 |
| 4,872,117 | 10/1989 | Suzuki et al. | 701/109 |
| 4,991,102 | 2/1991 | Sakamoto et al. | 701/109 |
| 5,001,643 | 3/1991 | Domino et al. | 701/109 |
| 5,713,332 | 2/1998 | Adler et al. | 123/674 |

FOREIGN PATENT DOCUMENTS

| | | | |
|---|---|---|---|
| 62-135635 | 6/1987 | Japan | 123/674 |
| 6-35850 | 5/1994 | Japan . | |
| 7-51907 | 6/1995 | Japan . | |
| 2524359 | 5/1996 | Japan . | |
| 8-261043 | 10/1996 | Japan . | |
| 9-42025 | 2/1997 | Japan . | |

*Primary Examiner*—Erick R. Solis
*Attorney, Agent, or Firm*—Flynn, Thiel, Boutell & Tanis, P.C.

[57] ABSTRACT

A method and apparatus for controlling the air-fuel ratio in an internal combustion engine wherein, when the operating condition of the internal combustion engine has shifted between learning zones, a learning control updates a correction value after the shift is made in accordance with a stand-by function of a control unit to reduce the occurrence of mislearning, perform the correction value updating learning control efficiently and effect the purification of exhaust gases. In the air-fuel ratio controlling method for the internal combustion engine, when the operating condition of the engine has shifted between learning zones, a learning control updates a correction value in accordance with a stand-by function. In the air-fuel ratio controlling apparatus for the internal combustion engine, a stand-by function is added to the control unit so that, when the operating condition of the engine has shifted between learning zones, a learning control for updating a correction value after the shift is conducted in a delayed manner in accordance with a preset wait count. Further, a stand-by function is added to the control unit so that the correction value updates learning control after the shift is performed, in a delayed manner in accordance with a preset wait time.

5 Claims, 8 Drawing Sheets

SKIP WAIT COUNT IN VARIOUS ZONES

SKIP WAIT COUNT ACCORDING TO THE DEGREE OF ZONE SHIFT

FIG. 7
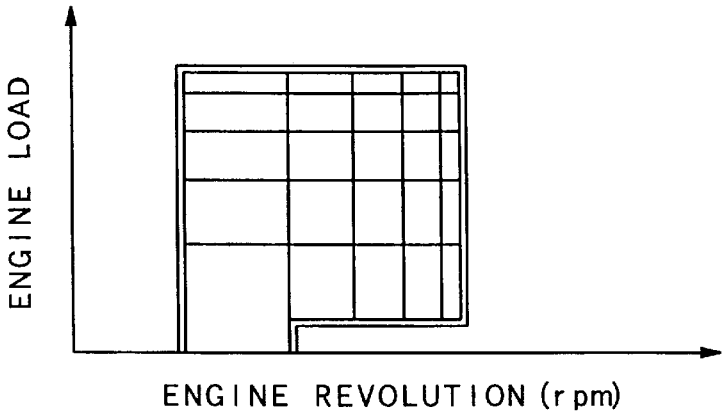
FIG. 8
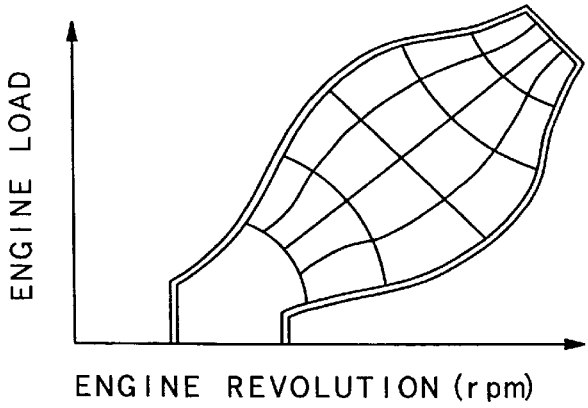
PRIOR ART FIG. 9
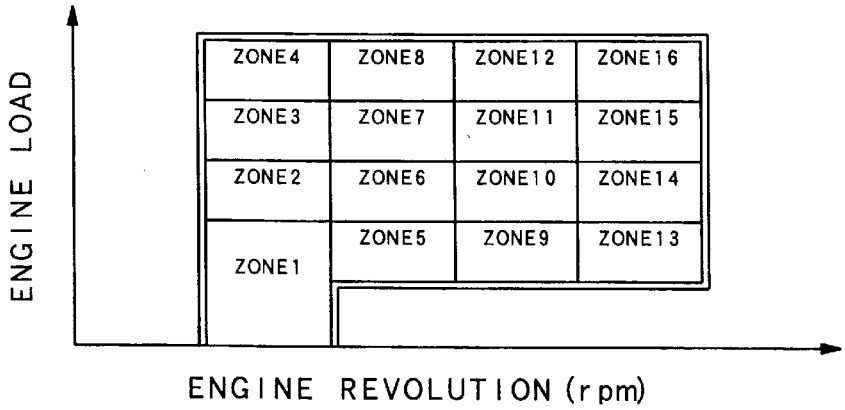
AIR-FUEL RATIO LEARNING CORRECTION ZONE

OPERATION ZONES FOR LEARNING ZONES

METHOD AND APPARATUS FOR CONTROLLING THE AIR-FUEL RATIO IN AN INTERNAL COMBUSTION ENGINE

FIELD OF THE INVENTION

The present invention relates to a method and apparatus for controlling the air-fuel ratio in an internal combustion engine wherein, when an operating condition of the internal combustion engine has shifted between zones, a learning control for updating a correction value after the shift is performed in accordance with a stand-by function added to a control means, whereby not only mislearnings can be diminished but also the correction value updating learning control can be made efficiently and the purification of exhaust gases can be effected.

BACKGROUND OF THE INVENTION

Some internal combustion engines mounted on vehicles have an $O_2$ sensor disposed as an exhaust sensor in an exhaust passage and are provided with a control means which makes a feedback control in accordance with a detection signal output from the $O_2$ sensor so that the air-fuel ratio becomes a target value.

Such a method and apparatus for controlling the air-fuel ratio in an internal combustion engine are disclosed in Japanese Patent No. 2524359. According to a fuel controller for an internal combustion engine disclosed in this patent, a flow characteristic correction quantity in a fuel supply means, an output characteristic correction quantity in an intake air volume detecting means and an invalid time correction quantity in the fuel supply means are separated from a learning value of a correction quantity related to the amount of fuel supplied and are updated while selecting a load region in which the accuracy of the correction quantities is improved, thereby performing an air-fuel ratio feedback control in high response and controlling the fuel supply in an open control with a high accuracy.

According to a learning control method for the airfuel ratio in an internal combustion engine disclosed in Japanese Patent Publication No. 6-35850, when a shift is made from a state in which a feedback control is not executed to a state in which a feedback control is being executed, learning is prohibited by a predetermined skip count.

According to an air-fuel ratio learning control apparatus disclosed in Japanese Patent Publication No. 7-51907, even when an operating condition of an engine is in the vicinity of a boundary portion of an operation zone which is set in one memory means, if in an operation zone set in the other memory means the engine operating condition does not lie in the boundary portion and is a steady operating condition, learning is always performed by one of the memory means.

In Japanese Patent Laid Open No. 8-261043 there is disclosed a learning control method for the air-fuel ratio in an internal combustion engine in which a basic fuel injection volume is calculated on the basis of both the opening of a throttle valve disposed in an intake system of the engine and the number of revolutions of the engine, then a feedback correction quantity is calculated with a predetermined period and in accordance with an output signal provided from an $O_2$ sensor mounted in an exhaust system, then the basic fuel injection volume is corrected on the basis of at least the feedback correction quantity to determine a final fuel injection volume, and a learning control is made for the air-fuel ratio. According to this learning control method, when a predetermined time has elapsed until reversal of the output signal, an auxiliary correction quantity is calculated from both a feedback correction quantity calculated before lapse of the predetermined time and a feedback correction quantity of this time calculated upon lapse of the predetermined time, then a learning correction quantity is calculated on the basis of the thus-calculated auxiliary correction quantity, and where the thus-calculated learning correction quantity satisfies predetermined conditions, the learning correction quantity stored in the learning zone concerned is updated quickly using the calculated learning correction quantity.

In Japanese Patent Laid Open No. 42025/97 there is disclosed a control apparatus for controlling the air-fuel ratio in an internal combustion engine, comprising a fuel injection valve which injects a fuel fed under pressure from a fuel tank into a combustion chamber in the internal combustion engine, an air-fuel ratio detecting means disposed in an exhaust system of the engine to detect an air-fuel ratio from exhaust gases, an air-fuel ratio correction coefficient calculating means for calculating an air-fuel ratio correction coefficient in accordance with the detected air-fuel ratio, a feedback control means for feedback-controlling an operation quantity of the fuel injection valve on the basis of the air-fuel ratio correction coefficient which is calculated in such a manner that the air-fuel ratio falls under a predetermined range, a learning control means which learns an air-fuel ratio correction quantity according to an operating condition of the engine while changing an update quantity according to a fetch count or fetch time of the air-fuel ratio correction coefficient, and a correction means for correction the operation quantity of the feedback-controlled fuel injection valve in accordance with the learned air-fuel ratio correction quantity. According to this air-fuel ratio control apparatus, the change of updating the learning value is increased and there is realized an air-fuel ratio control of high accuracy.

In the conventional air-fuel ratio controlling apparatus for an internal combustion engine, the air-fuel ratio is feedback-controlled in accordance with a detection signal provided from an $O_2$ sensor as an exhaust sensor and a learning correction of the air-fuel ratio is performed for absorbing variations in the internal combustion engine, sensors and various devices.

In the learning correction according to the prior art, as shown in FIG. 9 for example, a map based on the relation between engine load and engine revolution is divided into a plurality of zones (for example, sixteen zones from ZONE 1 to ZONE 16), and when an operating condition of the internal combustion engine has entered any of the zones, if the operating condition is a steady condition and if the skip of the feedback control has been conducted a preset number of times, the correction value as a learning value in the zone concerned is updated.

The above update control will now be described with reference to a prior art air-fuel ratio controlling flowchart of FIG. 10. Once an air-fuel ratio control program starts (300), judgment is made as to whether a feedback control is being executed or not (302), and if the answer is negative, the judgment is repeated until the answer becomes affirmative. If the answer in the judgment (302) is affirmative, the flow shifts to judgment (304) as to whether engine water temperature and intake air temperature conditions exist or not on the basis of detection signals provided from a water temperature sensor and an intake air temperature sensor, respectively.

If the answer in the judgment (304) is negative, the flow returns to the judgment (302) as to whether the feedback control is being executed or not, while if the answer in the judgment (304) is affirmative, the flow shifts to judgment (306) as to whether the engine operating condition is within a learning zone or not in such a map based on the relation between engine load and engine revolution as shown in FIG. 9.

If the answer in the judgment (306) is negative, the flow returns to the judgment (302) as to whether a feedback control is being executed or not, while if the answer in the judgment (306) is affirmative, there is made judgment (308) as to whether the operating condition is a steady condition, or a steady running condition, or not and if the answer is negative, the flow returns to the judgment (302) as to whether a feedback control is being executed or not, while if the answer in the judgment (308) is affirmative, the flow shifts to judgment (310) as to whether skip was executed or not in the feedback control after the operating condition had been judged to be a steady condition.

If the answer in the judgment (310) is negative, the flow returns to the judgment (302) as to whether a feedback control is being executed or not, and if the answer is affirmative, a counter is incremented (312).

After the counter incrementing process (312), there is made judgment (314) as to whether the count value of the counter has reached a preset count, i.e., a preset value, or more and if the answer is negative, the flow returns to the judgment (310) as to whether skip has been executed or not in the feedback control, while if the answer in the judgment (314) is affirmative, updating of a learning value, i.e., a correction value, is started (316), and after updating of the correction value, the flow shifts to Return (318).

The reason why skip is waited for by a preset count in the learning value or correction value updating learning control as noted above is that at the time of shift from an accelerating or decelerating condition to a steady condition there usually occurs a discrepancy in the air-fuel ratio under the influence of an increase or decrease of fuel corrected at the time of acceleration or deceleration.

The operation zone, when observed in detail, can be broadly divided into a zone (a steady running zone in FIG. 11) which is used mainly in a steady running at a constant speed, a zone (an acceleration zone in FIG. 11) which is used mainly in acceleration, and a zone (a deceleration zone in FIG. 11) which is used mainly in deceleration.

At present, however, even when the operating condition has shifted to any of the above three zones, the skip wait count until start of the updating learning control is constant.

As a result, there are formed a zone in which mislearning is apt to occur such as the acceleration zone and the deceleration zone and a zone (steady running zone) in which the correction value as a learning value is difficult to update although the occurrence of mislearning is less possible. Thus, it is difficult to obtain an exact correction value as a learning value and this point is one cause of discharge of exhaust gases containing harmful components.

SUMMARY OF THE INVENTION

According to the present invention there is provided in one aspect thereof a method for controlling the air-fuel ratio in an internal combustion engine wherein, in accordance with a detection signal from an exhaust sensor disposed in an exhaust passage of the internal combustion engine, a feedback control is made by a control means so that the air-fuel ratio becomes a target value, an operation zone is divided into a plurality of zones, and when an operating condition of the internal combustion engine has entered one of the zones, if the operating condition is in a steady condition, and after a preset feedback control has been conducted, a learning control is made to update a correction value in the feedback control for the zone concerned, wherein a stand-by function is added to the control means, and when the operating condition of the internal combustion engine has shifted between the zones, the learning control updated the correction value after the shift is performed in accordance with the stand-by function.

According to the present invention, in another aspect thereof, there is provided an apparatus for controlling the air-fuel ratio in an internal combustion engine, including a control means which makes a feedback control so that the air-fuel ratio becomes a target value in accordance with a detection signal from an exhaust sensor disposed in an exhaust passage of the internal combustion engine and which, when an operating condition of the internal combustion engine has entered one of a plurality of divided learning zones of an operation zone, if the operating condition is a steady condition and after a preset feedback control has been conducted, makes a learning control to update a correction value in the feedback control for the learning zone concerned, wherein a stand-by function is added to the control means so that, when the operating condition of the internal combustion engine has shifted between the learning zones, the learning control updates the correction value after the shift is performed in a delayed manner in accordance with a preset wait count or a preset wait time.

According to the present invention summarized above, when the operating condition of the internal combustion engine has shifted between the learning zones, an updating learning control for the correction value after the shift is performed in accordance with the stand-by function to diminish mislearning and the control is made efficiently to attain the purification of exhaust gases.

Moreover, when the engine operating condition has shifted between the learning zones, an updating learning control for the correction value after the shift is performed in accordance with a wait count which is preset in the control means to diminish mislearning and the control is made efficiently to effect the purification of exhaust gases.

BRIEF DESCRIPTION OF THE DRAWINGS

FIG. 7 is a schematic diagram of a map showing a relationship between engine load and engine revolution in another modification according to the present invention;

FIG. 8 is a schematic diagram of a map showing a relationship between engine load and engine revolution in a further modification according to the present invention;

FIG. 9 is a schematic diagram of air-fuel ratio learning correction zones in a map based on the relationship between engine load and engine revolution according to the prior art related to the present invention;

DETAILED DESCRIPTION

Figure 1:
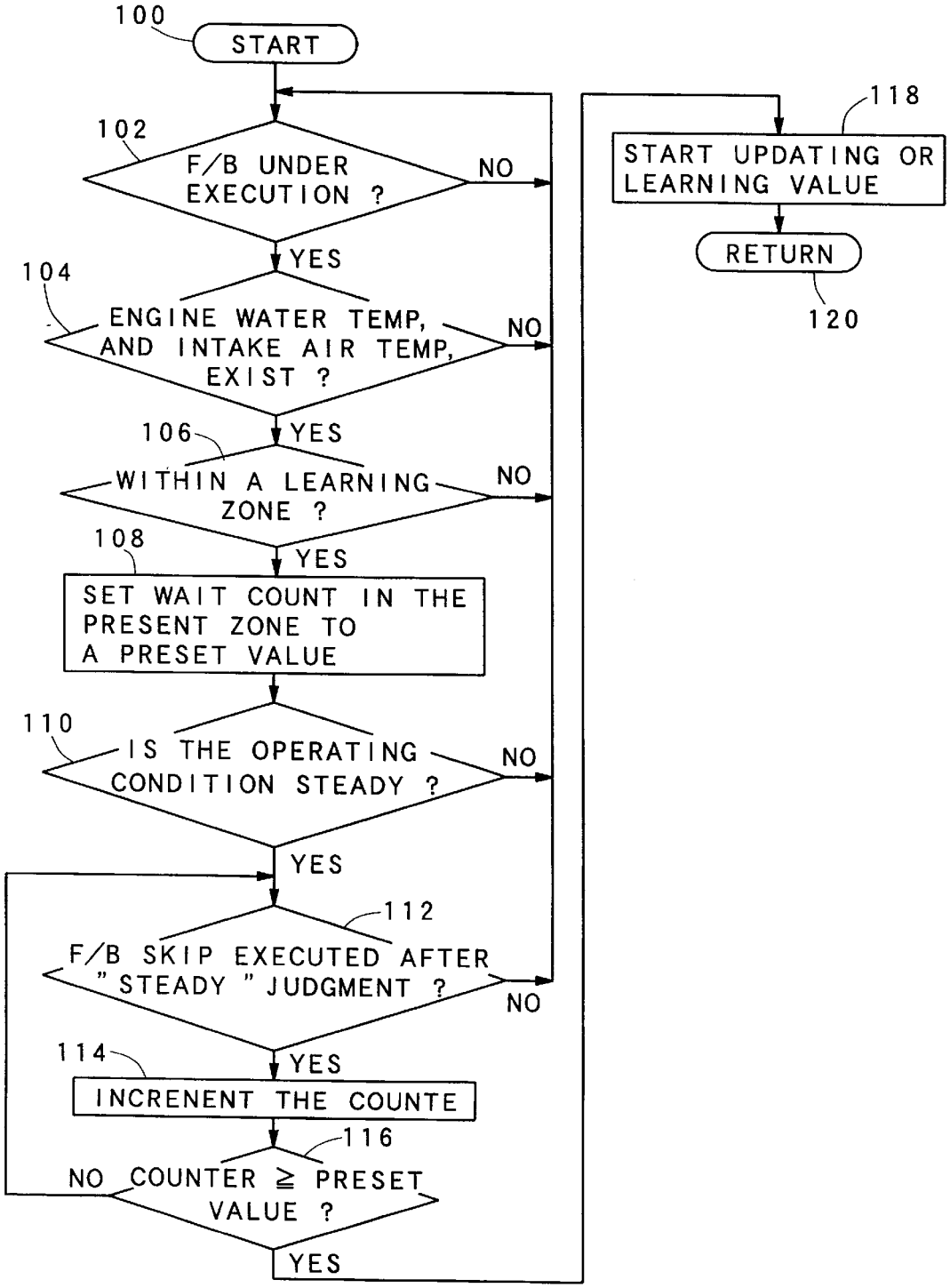
FIG. 1 is a flowchart for controlling the air-fuel ratio in an internal combustion engine according to a first embodiment of the present invention.
Figure 2:
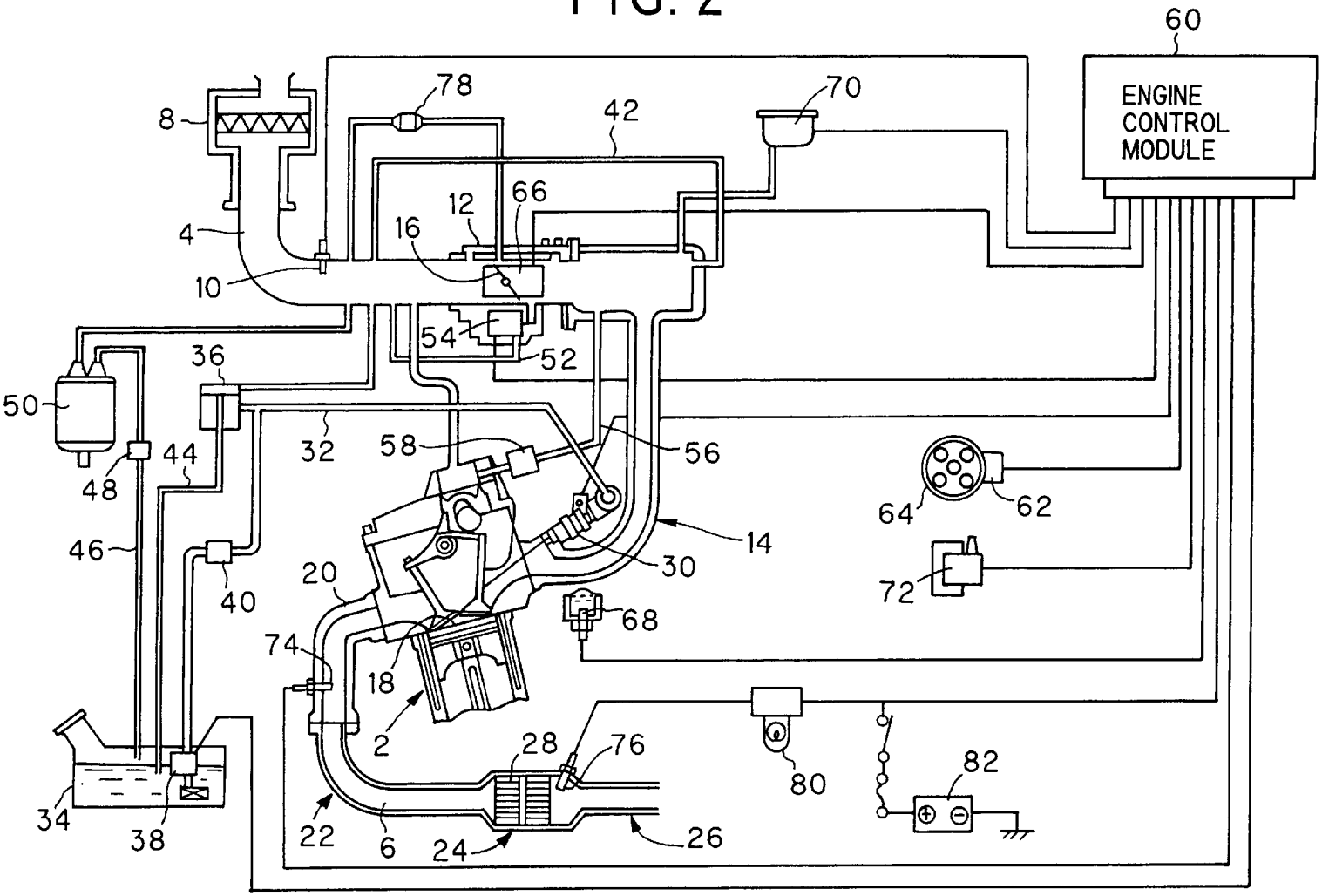
FIG. 2 is a schematic diagram of an air-fuel ratio controlling apparatus in the internal combustion engine.
Figure 3:
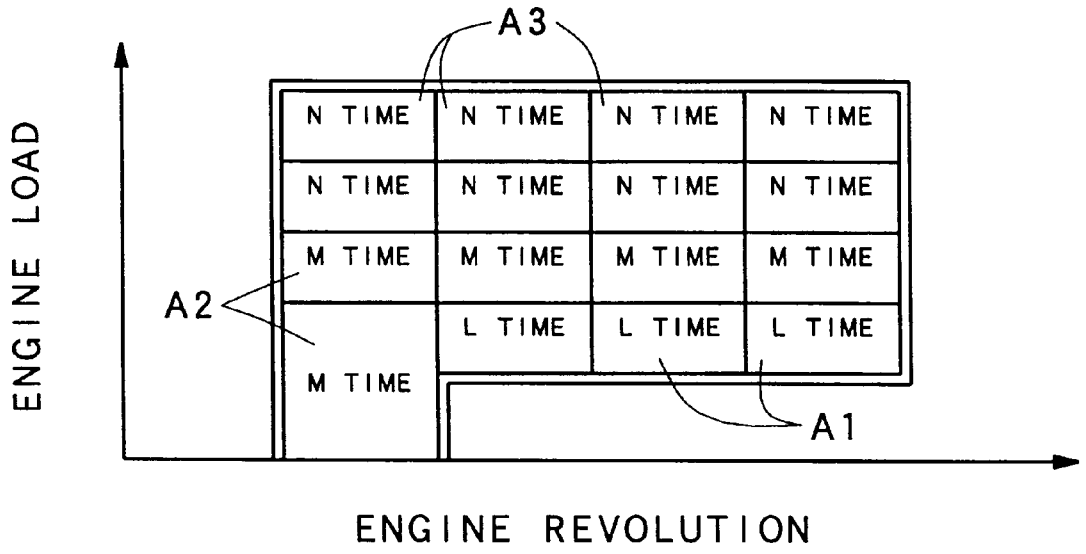
FIG. 3 is a schematic diagram showing skip wait counts in various zones in a map based on the relationship between engine load and engine revolution.

FIGS. 1 to 3 illustrate an air-fuel ratio control apparatus according to the first embodiment of the present invention. In FIG. 2, the reference numeral 2 denotes an internal combustion engine, numeral 4 denotes an intake passage, and numeral 6 denotes an exhaust passage. The intake passage 4 in the internal combustion engine 2 comprises an air cleaner 8, an intake air temperature sensor 10, a throttle body 12 and an intake manifold 14, which are connected successively from an upstream side. In a portion of the intake passage 4 located within the throttle body 12 is mounted an intake throttle valve 16. The intake passage 4 is in communication with a combustion chamber 18 in the internal combustion engine 2.

The exhaust passage 6, which is in communication with the combustion chamber 18 of the engine 2, comprises an exhaust manifold 20, an upstream-side exhaust pipe 22, a catalytic converter 24, and a downstream-side exhaust pipe 26, which are connected successively from the upstream side. In a portion of the exhaust passage 6 located within the catalytic converter 24 is disposed a catalyst 28.

In the internal combustion engine 2 is disposed a fuel injection valve 30 so as to face the combustion chamber 18. The fuel injection valve 30 is communicated with both a fuel tank 34 and a fuel pressure regulator 36 by means of a fuel supply passage 32 through a fuel distributing passage (not shown). Fuel stored in the fuel tank 34 is fed under pressure by means of a fuel pump 38 and, after removal of dust through a fuel filter 40, it is distributed to the fuel injection valve 30 through the fuel supply passage 32.

The fuel pressure regulator 36 regulates the fuel pressure to a constant value with use of an intake pressure introduced from a pressure introducing passage 42 which is in communication with the intake passage 4, and returns surplus fuel to the fuel tank 34 through a fuel return passage 44.

The fuel tank 34 is in communication, through an evaporated fuel passage 46, with a portion of the intake passage 4 located within the throttle body 12, and at intermediate positions of the evaporated fuel passage 46 are disposed a two-way valve 48 and a canister 50. In the throttle body 12 is formed a by-pass 52 which by-passes the intake throttle valve 16, and at an intermediate position of the by-pass 52 is disposed an idling air volume control valve 54. Numeral 56 denotes a blow-by gas passage and numeral 58 denotes a positive crankcase ventilation (i.e. PVC) valve.

The fuel injection valve 30 and the idling air volume control valve 54 are connected to a control unit (engine control module) 60 as a control means. To the control unit 60 are connected a crank angle sensor 62, a distributor 64, a throttle position sensor 66, a water temperature sensor 68, a pressure sensor 70, and an ignition coil 72.

In the internal combustion engine 2, a first $O_2$ sensor 74 and a second $O_2$ sensor 76, which are exhaust sensors for detecting an oxygen concentration as an exhaust component value, are mounted in the exhaust passage 6 on upstream and downstream sides, respectively, of the catalyst 28. The first and second $O_2$ sensors 74, 76 are connected to the control unit 60.

Numeral 78 denotes a one-way valve mounted in the evaporated fuel passage 48 at a position between the intake passage 4 and the canister 50. Numeral 80 denotes a warning lamp and numeral 82 denotes a battery.

In the air-fuel ratio control apparatus, the operation of the fuel injection valve 30 is feedback-controlled by the control unit 60 so that the air-fuel ratio becomes a target value, in accordance with first and second detection signals provided from the first and second $O_2$ sensors 74, 76, respectively. With this control, the air-fuel ratio control apparatus improves the efficiency of exhaust gas purification performed by the catalyst 28 and thereby diminishes the proportion of harmful components.

To be more specific, according to the air-fuel ratio control apparatus in the internal combustion engine 2, two first and second $O_2$ sensors 74, 76 are disposed in the exhaust passage 6 respectively upstream and downstream of the catalyst 28, and by the control unit 60 there is made a first feedback control so that the air-fuel ratio becomes a target value in accordance with a first detection signal provided from the first $O_2$ sensor 74, while in accordance with a second detection signal provided from the second $O_2$ sensor 76 there is made a control to correct the first feedback control.

In the air-fuel ratio controlling method according to the present invention, an operation zone is divided into a plurality of zones, and when the operating condition of the internal combustion engine 2 has entered one of the zones, if the engine operating condition is a steady condition and after a preset feedback control (also called "F/B control") has been conducted, there is made a learning control to update a correction value for the feedback control in the zone concerned. According to this air-fuel ratio control method, a stand-by function is added to the control unit 60 and when the operating condition of the internal combustion engine 2 has shifted between the zones, the updating learning control for the above correction value after the shift is performed in accordance with the said stand-by function.

Actually, a stand-by function is added to the control unit 60 so that, when the operating condition of the engine 2 has shifted between the learning zones, the updating learning control for the correction value is performed in a delayed manner in accordance with a preset skip wait count.

More particularly, first a map based on the relation between engine load and engine revolution is divided into a plurality of zones (also called "learning zones") A as in FIG. 3.

At this time, the control unit 60 presets the skip wait count at the position of the learning zone before the shift and differently according to the degree of the learning zone shift. To be more specific, as shown in FIG. 3, skip wait counts are preset in such a manner as "L time" in a deceleration zone A1, "M time" in a steady running zone A2 and "N times" in an acceleration zone A3. Thus deceleration zone A1 includes all of the zones labeled "L" in FIG. 3, and steady running zone A2 includes all of the zones labeled "M" in FIG. 3. Acceleration zone A3 includes all of the zones labeled "N" in FIG. 3.

The following two timings are conceivable as timings for presetting the skip wait count:

(1) With the operating condition entered in the learning zone before the shift, namely, a past learning zone, the skip wait count in another learning zone after the shift, namely, the present learning zone, is set.

(2) After the shift, namely, after the shift to the present learning zone, the skip wait count is retrieved and set from the learning zone before the shift, namely, a past learning zone.

In the steady running zone A2, in order for the updating learning control to be carried out quickly, the skip wait count is set, for example, to "M time" which is a smaller time than in the prior art, while in the deceleration zone A1 and acceleration zone A3, the air-fuel ratio often becomes unstable for a while before and after the shift and therefore the skip wait count is set, for example, to "L time" or "N time" larger than in the prior art to prevent the occurrence of mislearning. The preset values are in the following relationship of magnitude:

M<L, M<N

Description will now be directed to the operation with reference to an air-fuel ratio control in flowchart of FIG. 1.

Once an air-fuel ratio controlling program starts (100), there is made judgment (102) as to whether a feedback control is being executed or not, and if the answer is negative, this processing is repeated until the answer in the judgment (102) becomes affirmative, then when the answer becomes affirmative, the flow or process shifts to judgment (104) as to whether preselected engine water temperature and intake air temperature conditions exist or not in accordance with detection signals provided from the water temperature sensor 68 and intake air temperature sensor 10, respectively.

If the answer in the judgment (104) is negative, the flow or process returns to the judgment (102) as to whether a feedback control is being executed or not, while if the answer in the judgment (104) is affirmative, the flow shifts to judgment (106) as to whether the operating condition is within a learning zone in such a map based on the relation between engine load and engine revolution (rpm) as in FIG. 3.

If the answer in the judgment (106) is negative, the flow or process returns to the judgment (102) as to whether a feedback control is being executed or not, while if the answer in the judgment (106) is affirmative, the skip wait count corresponding to the present zone is set to a preselected or preset value (108). More specifically, if the present zone is the deceleration zone A1, "L time" is set to the preset value; if the present zone is the steady running zone A2, "M time" is set to the preset value; and if the present zone is the acceleration zone A3, "N time" is set to the preset value.

After the skip wait count presetting process (108), there is made judgment (110) as to whether the operating condition is a steady condition, i.e., a steady running condition, or not, and if the answer is negative, the flow returns to the judgment (102) as to whether a feedback control is being executed or not, while if the answer in the judgment (110) is affirmative, the process or flow shifts to judgment (112) as to whether skip was executed in the feedback control after the operating condition had been judged to be a steady condition.

If the answer in the judgment (112) is negative, the flow returns to the judgment (102) as to whether a feedback control is being executed or not, while if the answer in the judgment (112) is affirmative, the counter in the control unit 60 is incremented (114).

After the counter incrementing process (114), there is made judgment (116) as to whether the counter has reached the foregoing preset value or more, and if the answer is negative, the process or flow returns to the judgment (112) as to whether skip was executed in the feedback control, while if the answer in the judgment (116) is affirmative, updating of the learning value, or a correction value, is started (118), and after completion of the updating, the flow shifts to Return (120).

Thus, with a stand-by function added to the control unit 60, when the operating condition of the internal combustion engine 2 has shifted between learning zones, an updating learning control for the correction value after the shift can be done in accordance with the standby function added to the control unit 60, whereby not only the occurrence of mislearning can be diminished, but also the learning control for updating the correction value can be done efficiently and it is possible to effect the purification of exhaust gases, which is advantageous in practical use.

Besides, all that is required is merely changing the program in the control unit 60 and hence there is no fear of the construction becoming complicated; that is, manufacture is easy and cost can be kept low, which is advantageous also from the economic point of view.

Moreover, since a stand-by function is added to the control unit 60 so that, when the operating condition of the internal combustion engine 2 has shifted between learning zones, the learning control for updating the correction value after the shift is made in a delayed manner in accordance with a preset skip wait count, it is possible to not only diminish the occurrence of mislearning, but also carry out the updating learning control for the correction value efficiently and effect the purification of exhaust gases. Thus, there accrues an advantage in practical use.

Further, since the control unit 60 is endowed with a function of presetting the skip wait count at the position of the learning zone before the shift and differently according to the degree of the learning zone shift, it is possible to make large the skip wait count in the deceleration or acceleration zone and hence possible to surely prevent the occurrence of mislearning in a zone where the air-fuel ratio is unstable.

Figure 4:
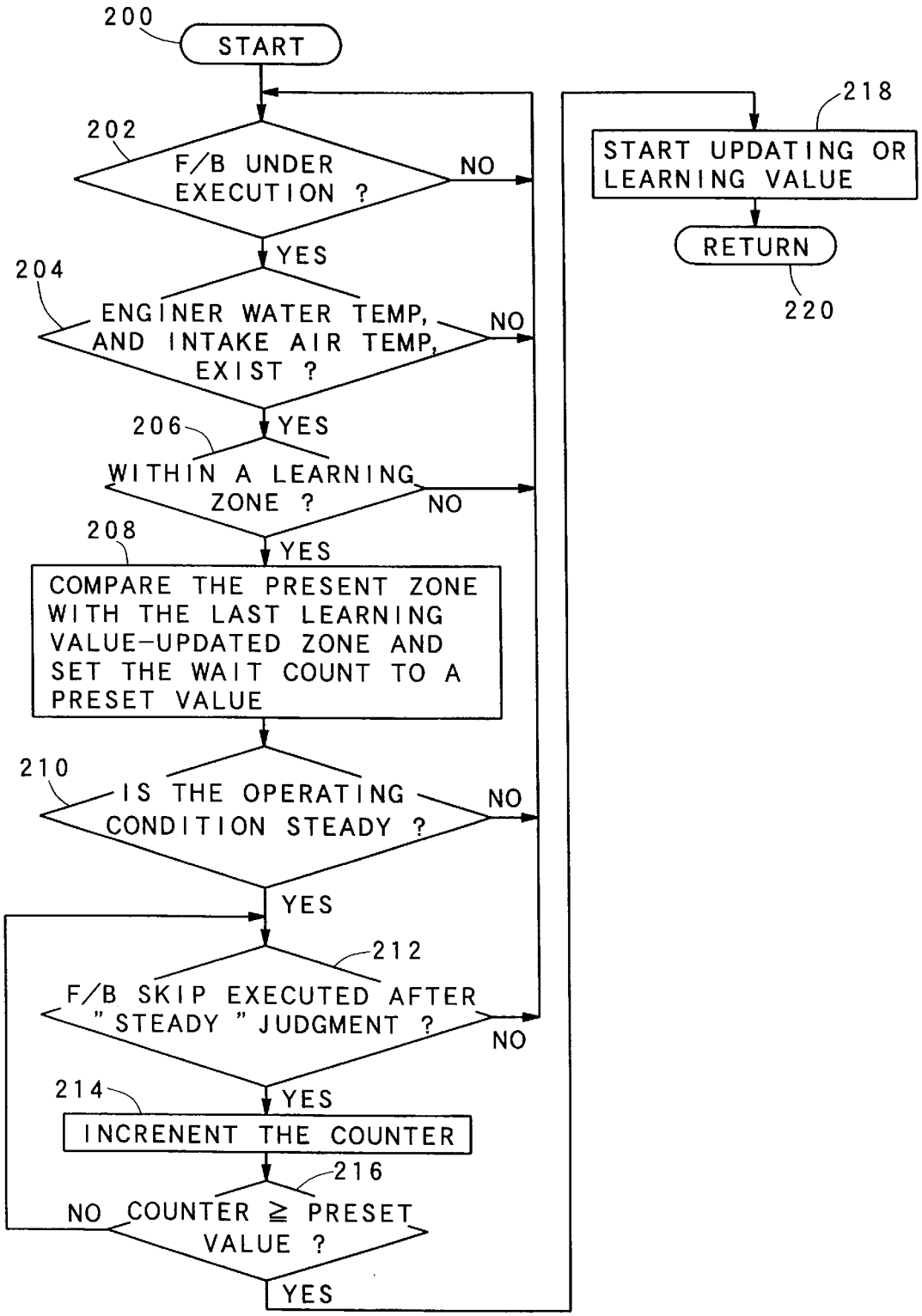
FIG. 4 is a flowchart for controlling the air-fuel ratio in the internal combustion engine according to a second embodiment of the present invention.
Figure 5:
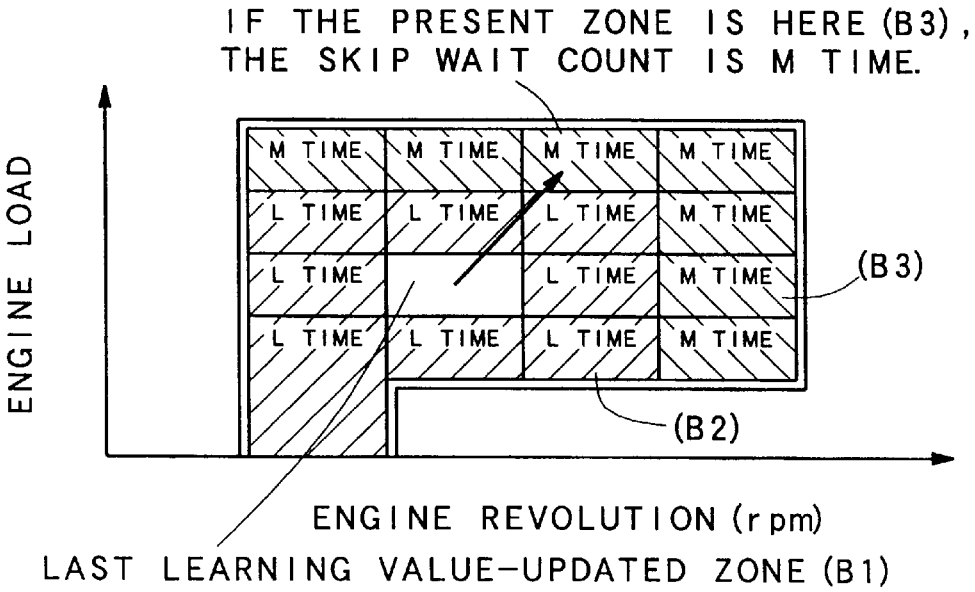
FIG. 5 is a schematic diagram showing skip wait counts according to the degree of zone shift in a map based on the relationship between engine load and engine revolution for the embodiment of FIG. 4.

FIGS. 4 and 5 illustrate the second embodiment of the present invention. In this second embodiment, the portions which fulfill the same functions as in the above first embodiment are identified by the same reference numerals as in the first embodiment.

The second embodiment is characterized by a construction in which the degree of separation between a zone is updated with a correction value as the last learning value and the present zone is detected. Then the skip wait count is changed or set to a preset or preselected value according to the thus-detected degree of separation to cope with sudden acceleration and sudden deceleration.

To be more specific, a map based on the relation between engine load and engine revolution is divided into a plurality of zones (also called "learning zones") B, as shown in FIG. 5.

If the zone for which a correction value as the last learning value has been updated, i.e., an updated zone, is assumed to be B1, the skip wait count of a zone B2 adjacent to the updated zone B1 is set at "L time" and that of a spaced zone B3 spaced one zone from the updated zone B1 is set at "M time." For example, if the present zone is the spaced zone B3, the skip wait count is "M time," as shown in FIG. 5.

In the case where two or more zones are spaced from the updated zone B1, their skip wait count is set separately. More specifically, where the number of spaced zones is two, the skip wait count is set at "N time," and where the number of spaced zones is three, the skip wait count is set at "P time."

The relation of magnitude among the above skip wait counts is set as follows:

L<M<N<P

This is for the following reason. In a zone adjacent to the updated zone, a slow acceleration or deceleration is performed in many cases and hence the air-fuel ratio is little disturbed, so the skip wait count is set at a small value, while in a zone spaced from the updated zone, a sudden acceleration or deceleration is performed in many cases and therefore the skip wait count is set large to stabilize the air-fuel ratio before learning.

The following description is now provided with reference to an air-fuel ratio controlling flowchart of FIG. 4. Once an air-fuel ratio controlling program starts (200), there is made judgment (202) as to whether a feedback control is being executed or not and if the answer is negative, this processing is repeated until the answer in the judgment (202) becomes affirmative. If the answer in the judgment (202) is affirmative, the process or flow shifts to judgment (204) as to whether preselected or predetermined engine water temperature and intake air temperature conditions exist or not in accordance with detection signals provided from the water temperature sensor 68 and intake air temperature sensor 10, respectively.

If the answer in the judgment (204) is negative, the process or flow returns to the judgment (202) as to whether a feedback control is being executed or not, while if the answer in the judgment (204) is affirmative, the flow shifts to judgment (206) as to whether the operating condition is within a learning zone in such a map based on the relation between engine load and engine revolution (rpm) as shown in FIG. 5.

If the answer in the judgment (206) is negative, the process or flow returns to the judgment (202) as to whether a feedback control is being executed or not, while if the answer in the judgment (206) is affirmative, a comparison is made between the present zone and the zone updated with a correction value as the last learning value and a skip wait count proportional to the degree of separation between both zones is set to a preset value (208).

The processing (208) is followed by judgment (210) as to whether the operating condition is a steady condition, i.e., a steady running condition, or not and if the answer is negative, the flow returns to the judgment (202) as to whether a feedback control is being executed or not, while if the answer in the judgment (210) is affirmative, the process or flow shifts to judgment (212) as to whether skip was executed in the feedback control after the operating condition had been judged to be a steady condition.

If the answer in the judgment (212) is negative, the flow returns to the judgment (202) as to whether a feedback control is being executed or not, while if the answer in the judgment (212) is affirmative, the counter in the control unit 60 is incremented (214).

After the counter incrementing process (214), there is made judgment (216) as to whether the count value of the counter has reached the above preset value or more, and if the answer is negative, the process or flow returns to the judgment (212) as to whether skip was executed or not in the feedback control, while if the answer in the judgment (216) is affirmative, updating of the learning value, or a correction value, is started (218), and thereafter the flow shifts to Return (220).

Now, it is possible to change the skip wait count according to the degree of separation between the zone updated with the correction value as the last learning value and the present zone, and hence it is possible to cope with sudden acceleration or deceleration. Thus, with the skip wait count, it is possible to effect the learning control for updating the correction value, as in the previous first embodiment, whereby not only the occurrence of mislearning can be diminished but also the learning control for updating the correction value can be done efficiently, and it is possible to effect the purification of exhaust gases. Thus, there accrues an advantage in practical use.

The present invention is not limited to the above first and second embodiments. Various applications and modifications may be made.

Figure 6:
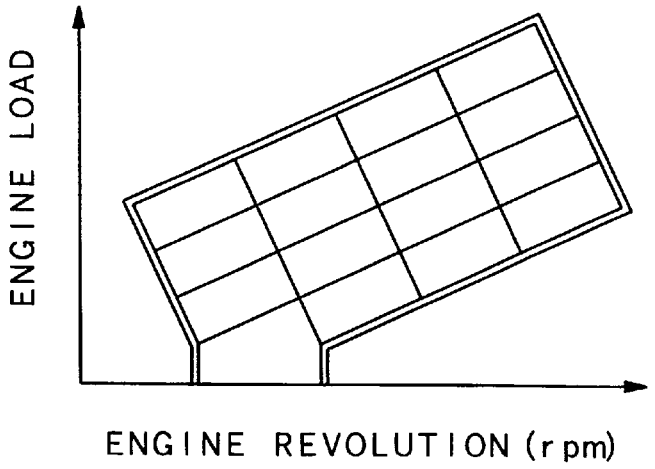
FIG. 6 is a schematic diagram of a map showing a relationship between engine load and engine revolution in a modification according to the present invention.
Figure 10:
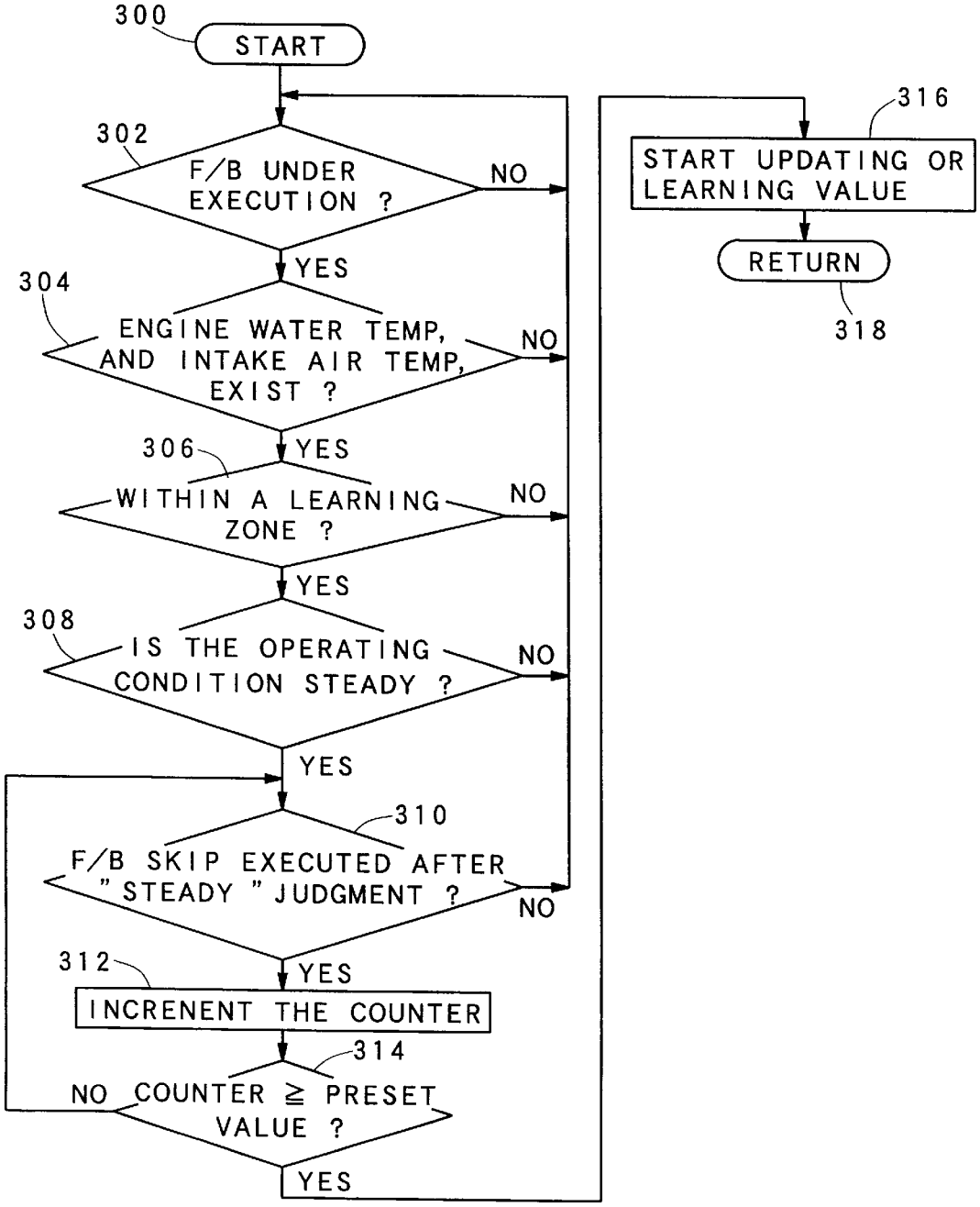
FIG. 10 PRIOR ART
FIG. 10 is an air-fuel ratio controlling flowchart for a prior art internal combustion engine.
Figure 11:
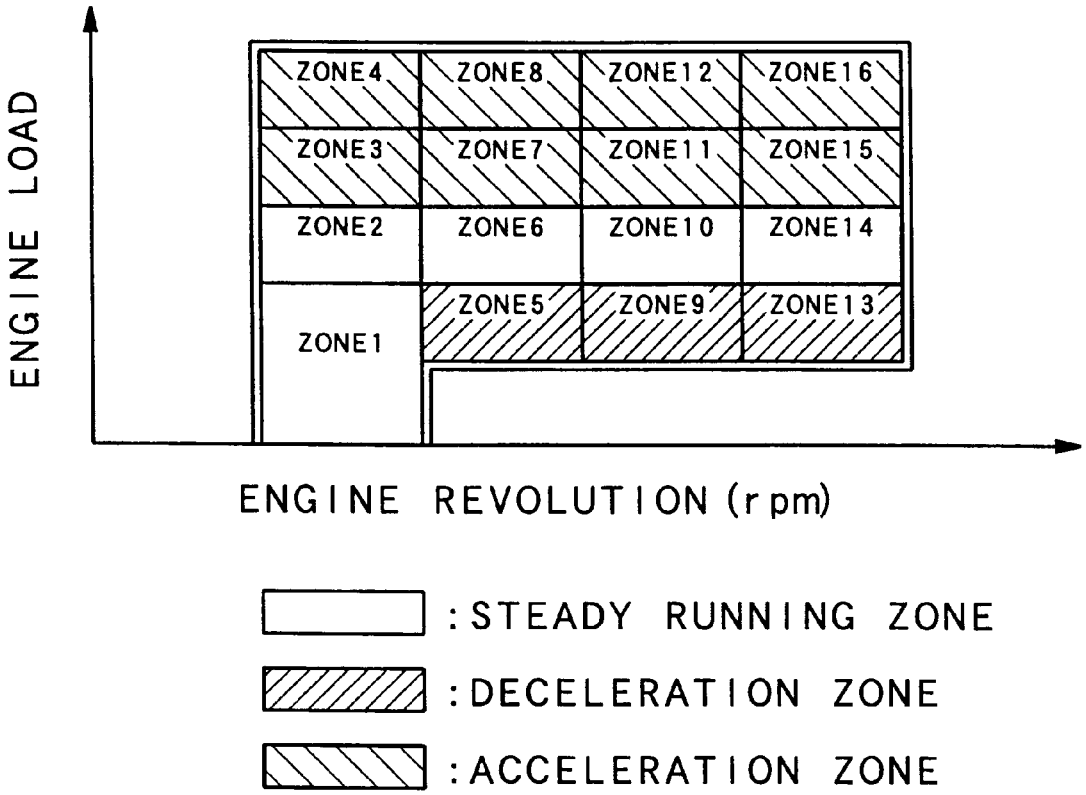
FIG. 11 PRIOR ART
FIG. 11 is a schematic diagram showing operation zones for learning zones in a map based on the relationship between engine load and engine revolution for the engine of FIGS. 9 and 10.

For example, in the above first and second embodiments, a map based on the relation between engine load and engine revolution (rpm) is divided into a plurality of zones (also designated "learning zones") which are defined at about the same size by vertical lines parallel to the axis of ordinate with engine load plotted therealong and horizontal lines parallel to the axis of abscissa with engine revolution plotted therealong. However, the aforesaid map may have directivity in the directions of increase in both engine load and engine revolution, as shown in FIG. 6, or the zone area is reduced gradually with increase in both engine load and engine revolution, as shown in FIG. 7, or the zone area is reduced partially, that is, in only required portions though not shown, or zone-to-zone boundary lines are curved as in FIG. 8.

Although in the first and second embodiment the skip wait count was used in the learning control for updating the correction value as a learning value, there may be used a wait time instead of the skip wait count. In this connection, a stand-by function is added to the control unit so that, when the operating condition of the internal combustion engine has shifted between learning zones, the learning control for updating the correction value after the shift is performed in a delayed manner in accordance with a preset wait time. Thus, since the correction value updating learning control can be done in accordance with the wait time, it is possible to not only diminish the occurrence of mislearning but also conduct the said learning control efficiently and effect the purification of exhaust gases. This is advantageous in practical use. If the control unit is endowed with a function of presetting the wait time at the position of the learning zone before the shift and differently according to the degree of the learning zone shift, it is possible to make the wait time large in the deceleration or acceleration zone and thereby surely prevent the occurrence of mislearning in a zone where the air-fuel ratio is unstable.

According to the present invention, as described in detail hereinabove, in a method for controlling the air-fuel ratio in an internal combustion engine 2 wherein, in accordance with a detection signal from an exhaust sensor disposed in an exhaust passage of the internal combustion engine, a feedback control is made by a control means 60 so that the air-fuel ratio becomes a target value, an operation zone is divided into a plurality of zones, and when an operating condition of the internal combustion engine has entered one of the zones, if the operating condition is a steady condition and after a preset feedback control has been conducted, a learning control is made to update a correction value in the feedback control for the zone concerned: a stand-by function is added to the control means, and when the operating condition of the internal combustion engine has shifted between the zones, the learning control updates the correction value after the shift in accordance with the stand-by function. According to this method, when the operating condition of the internal combustion engine 2 has shifted between the zones, the learning control for updating the correction value after the shift is conducted in accordance with the stand-by function added to the control means, whereby not only the occurrence of mislearning can be diminished but also it is possible to perform the correction value updating learning control efficiently and effect the purification of exhaust gases. Thus, there accrues an advantage in practical use. Besides, all that is required is merely changing the program in the control means, so there is no fear of the configuration becoming complicated, that is, manufacture is easy and cost can be kept low. This is also advantageous from the economic point of view.

Moreover, according to the present invention, in an apparatus for controlling the air-fuel ratio in an internal combustion engine 2, including a control means which makes a feedback control so that the air-fuel ratio becomes a target value in accordance with a detection signal from an exhaust sensor disposed in an exhaust passage of the internal combustion engine and which, when an operating condition of the internal combustion engine has entered one of a plurality of divided learning zones of an operation zone, if the operating condition is a steady condition and after a preset feedback control has been conducted, makes a learning control to update a correction value in the feedback control of the learning zone concerned: a stand-by function is added to the control means so that, when the operating condition of the internal combustion engine has shifted between the learning zones, the learning control updates the correction value after the shift in accordance with a preset wait count. According to this apparatus, when the operating condition of the internal combustion engine has shifted between the learning zones, the learning control for updating the correction value can be done in accordance with the wait count, whereby not only the occurrence of mislearning can be diminished, but also it is possible to perform the learning control for updating the correction value efficiently and effect the purification of exhaust gases. This is advantageous in practical use.

Further, according to the present invention, in an apparatus for controlling the air-fuel ratio in an internal combustion engine 2, including a control means 60 which makes a feedback control so that the air-fuel ratio becomes a target value in accordance with a detection signal from an exhaust sensor disposed in an exhaust passage of the internal combustion engine and which, when an operating condition of the internal combustion engine has entered one of a plurality of divided learning zones of an operation zone, if the operating condition is a steady condition and after a preset feedback control has been conducted, makes a learning control to update a correction value in the feedback control for the learning zone concerned: a stand-by function is added to the control means so that, when the operating condition of the internal combustion engine has shifted between the learning zones, the learning control for updating the correction value after the shift is performed in a delayed manner in accordance with a preset wait time. According to this apparatus, the learning control for updating the correction value can be done in accordance with the wait time, whereby the occurrence of mislearning can be diminished. Besides, the learning control for updating the correction value can be done efficiently and it is possible to effect the purification of exhaust gases. Thus, there accrues an advantage in practical use.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A method for controlling an air-fuel ratio in an internal combustion engine wherein, in accordance with a detection signal from an exhaust sensor disposed in an exhaust passage of the internal combustion engine, a preset feedback control is made by a control means so that the air-fuel ratio becomes a target value, an operation zone is divided into a plurality of zones, and when an operating condition of the internal combustion engine has entered one of said zones, if said operating condition is a steady condition, and after the preset feedback control has been conducted, a learning control is made to update a correction value in said feedback control for the zone concerned, wherein:

a stand-by function is added to said control means, and when the operating condition of the internal combustion engine has shifted between said zones, the learning control updates the correction value, after the shift is performed, in accordance with said stand-by function.

2. An apparatus for controlling an air-fuel ratio in an internal combustion engine, including a control means which makes a preset feedback control so that the air-fuel ratio becomes a target value in accordance with a detection signal from an exhaust sensor disposed in an exhaust passage of the internal combustion engine and which, when an operating condition of the internal combustion engine has entered one of a plurality of divided learning zones of an operation zone, if the operating condition is a steady condition and after the preset feedback control has been conducted, makes a learning control to update a correction value in said feedback control for the learning zone concerned, wherein:

a stand-by function is added to said control means so that, when the operating condition of the internal combustion engine has shifted between the learning zones, the learning control updates the correction value, after the shift is performed, in a delayed manner in accordance with a preset wait count.

3. An apparatus according to claim 2, wherein said control means sets the wait count in said correction value for updating the learning control beforehand at the position of the learning zone before the shift and differently according to the degree of the learning zone shift.

4. An apparatus for controlling an air-fuel ratio in an internal combustion engine, including a control means which makes a preset feedback control so that the air-fuel ratio becomes a target value in accordance with a detection signal from an exhaust sensor disposed in an exhaust passage of the internal combustion engine and which, when an operating condition of the internal combustion engine has entered one of a plurality of divided learning zones of an operation zone, if the operating condition is a steady condition and after the preset feedback control has been conducted, makes a learning control to update a correction value in said feedback control for the learning zone concerned, wherein:

a stand-by function is added to said control means so that, when the operating condition of the internal combustion engine has shifted between the learning zones, the learning control updates the correction value, after the shift is performed, in a delayed manner in accordance with a preset wait time.

5. An apparatus according to claim 4, wherein said control means sets the wait time in said correction value for updating the learning control beforehand at the position of the learning zone before the shift and differently according to the degree of the learning zone shift.

* * * * *